US008099974B2

(12) United States Patent
Diebold et al.

(10) Patent No.: US 8,099,974 B2
(45) Date of Patent: Jan. 24, 2012

(54) REFRIGERATOR WITH PRESSURE EQUALIZATION VALVE

(75) Inventors: Jürgen Diebold, Hermaringen (DE); Karl-Friedrich Laible, Langenau (DE); Michaela Malisi, Heidenheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 543 days.

(21) Appl. No.: 12/310,421

(22) PCT Filed: Aug. 1, 2007

(86) PCT No.: PCT/EP2007/057979

§ 371 (c)(1),
(2), (4) Date: Feb. 24, 2009

(87) PCT Pub. No.: WO2008/025637

PCT Pub. Date: Mar. 6, 2008

(65) Prior Publication Data

US 2009/0241585 A1 Oct. 1, 2009

(30) Foreign Application Priority Data

Aug. 29, 2006 (DE) ..... 20 2006 013 229 U

(51) Int. Cl.
*F25D 17/04* (2006.01)

(52) U.S. Cl. ..... 62/410; 62/412

(58) Field of Classification Search ..... 62/410, 62/406, 409, 449, 273, 412, 404, 268; 137/526, 137/215, 341, 360, 493.8; 312/401, 406.1, 312/406.2; 454/270, 271, 275, 276
See application file for complete search history.

(56) References Cited

U.S. PATENT DOCUMENTS

| | | | | |
|---|---|---|---|---|
| 2,564,023 | A * | 8/1951 | Miller | 137/533.17 |
| 3,167,931 | A | 2/1965 | Bryson | |
| 3,376,711 | A * | 4/1968 | Hagendoorn et al. | 62/410 |
| 3,680,329 | A * | 8/1972 | Burtis | 62/275 |
| 3,916,643 | A * | 11/1975 | Brown | 62/410 |
| 3,952,542 | A * | 4/1976 | Berkowitz | 62/409 |
| 4,116,213 | A * | 9/1978 | Kamezaki | 137/360 |
| 4,569,208 | A * | 2/1986 | Villa | 62/273 |
| 4,662,270 | A * | 5/1987 | Fiddler et al. | 454/195 |
| 5,461,831 | A * | 10/1995 | Michal | 52/1 |
| 6,176,776 | B1 * | 1/2001 | Finkelstein et al. | 454/195 |
| 6,374,620 | B1 * | 4/2002 | Markey | 62/89 |
| 6,672,094 | B1 * | 1/2004 | Carden et al. | 62/273 |
| 6,672,096 | B2 * | 1/2004 | Lopes | 62/331 |
| 7,107,780 | B2 * | 9/2006 | Bellini et al. | 62/273 |

FOREIGN PATENT DOCUMENTS

| | | | |
|---|---|---|---|
| DE | 3000202 | A1 | 7/1980 |
| DE | 10233216 | A1 | 2/2004 |

* cited by examiner

*Primary Examiner* — Mohammad Ali
(74) *Attorney, Agent, or Firm* — James E. Howard; Andre Pallapies

(57) ABSTRACT

A refrigerator including a housing with a chassis and a door enclosing a chilled interior; and a pressure equalization valve extending through a wall of the housing thereby facilitating an inflow of air from the surroundings into the interior and thereby blocking an outflow of air from the interior into the surroundings, the refrigerator comprising, a wall having a throughbore formed therein in a parallel flow arrangement with the pressure equalization valve, through which air can pass in two directions, wherein the flow of air is less than that of the airflow through the pressure equalization valve in the throughflow direction and greater than that of the air leakage value of the pressure equalization valve in the blocked direction.

9 Claims, 4 Drawing Sheets

REFRIGERATOR WITH PRESSURE EQUALIZATION VALVE

BACKGROUND OF THE INVENTION

The present invention relates to a refrigeration device, such as a refrigerator or freezer cabinet, with a pressure equalization valve which serves to prevent a vacuum occurring in the interior of the refrigeration device.

Each time that the door of a refrigeration device is opened, warm air enters, which then cools down again when the door is closed and creates a vacuum, through which the door is sucked against the front side of the chassis. This vacuum leads to the door remaining very difficult to open after it has been closed until such time as the pressure between interior and surroundings is equalized again. Although the pressure is always equalized again after some time, since the seal fitted between the door and the front side of the chassis of the refrigerator does not form a completely airtight seal, the general aim is to keep the leakage rate of this seal as low as possible, since air which is exchanged by way of leaks between the interior and the surroundings also always leads to an undesired entry of heat and moisture into the interior. The more precisely the refrigerator is made and the smaller the leakage rate is as a result, the longer the vacuum persists after the closure of the door.

Diverse door opening mechanisms have been proposed to solve the problem, which employ a lever or the like to amplify the force exerted by a user on a door handle for opening the door in order to prize the door away from the chassis against any vacuum obtaining in the interior.

Such door opening mechanisms necessarily comprise movable parts which are subjected during operation to considerable forces, so that they can eventually wear and malfunction.

In order to be able to open the door easily at any time, it has further been proposed that a pressure equalization valve be fitted into the housing wall of such a device, which, in the event of a vacuum obtaining in the interior, lets air flow in from the outside and which closes as soon as the pressure between the surroundings and the interior is equalized, so that an uncontrolled entry of heat and moisture into the interior is excluded.

It has been shown in practice that such a pressure equalization valve has a tendency to freeze solid during the operation of the refrigerator, so that the pressure is no longer equalized via the valve.

BRIEF SUMMARY OF THE INVENTION

The object of the invention is thus to create a refrigerator with a pressure equalization valve between the interior and the surroundings. in which the danger of the pressure equalization valve freezing up is overcome or at least reduced.

The object is achieved by a through-hole being formed in a wall of the housing in parallel to the pressure equalization valve which permits flow in two directions, the flow of which is less than that of the pressure equalization valve in its throughflow direction, but greater than the leakage value of the pressure equalization valve in its blocked direction.

The fact that the flow value of the through-hole is selected to be sufficiently low ensures that there is not a significant exchange of air between the surroundings and the interior of the refrigerator, imposing an unwanted heat and moisture load on the latter. On the other hand the through-hole makes it possible for flows of air with a lower flow rate which are caused by the periodic cooling down and heating up of the interior because of the intermittent operation of a refrigeration device to flow via the through-hole and not via the pressure equalization valve. It has surprisingly actually been shown that the freezing-up of the pressure equalization valve is generally not attributable to air flows which flow through the pressure equalization valve in each case after the closure of the door, but that significantly slower flows of air are the determining factor. The temperature of the interior of the refrigerator is, even if the door remains closed, not exactly constant, but fluctuates periodically, and each cooling down is associated with an inflow of air into the interior, whereas air flows out during heating up, i.e. one can refer in a figurative sense to the refrigerator "inhaling" and "exhaling". While the air is flowing constantly through the pressure equalization valve during a pressure equalization after the door is closed and moisture contained within it barely has the opportunity to be deposited on the valve, the inflow during inhalation is significantly smaller, so that the inflowing air is already cooling down in the pressure equalization valve and its moisture precipitates therein, with the result that the valve loses its mobility and becomes blocked.

By creating a narrow through-hole in parallel to the pressure equalization valve, the "inhaled" air no longer has to flow in via the pressure equalization valve and the danger of the valve freezing is overcome. The narrowness of the through-hole contributes to avoiding an uncontrolled exchange of air between the interior and the surroundings which goes beyond inhaling and exhaling.

In order if possible to prevent any exchange of air through the through-hole which goes beyond the level unavoidable because of fluctuations in the temperature of the interior, it is further preferable for the through-hole to follow a curved path through the wall.

Such a curved through-hole can additionally be significantly longer than the thickness of the wall through which it passes, so that a large surface is available in the through hole on which the moisture from the inhaled air can be precipitated. The likelihood of precipitated moisture filling up the cross-section of the through-hole and preventing the flow of air is thus reduced.

To avoid the moisture freezing up in the through-hole, it is useful for the through-hole to run in an essentially frost-free area of the housing. Since heating is conventionally frequently provided on a front side of the chassis, in order to prevent the door from freezing onto the chassis, the through-hole is advantageously arranged in the area of the housing heated up by this heater.

If in a known manner a sealing profile sealing a gap between door and chassis is anchored in a groove of the door, the through-hole advantageously extends between the walls of the groove and an anchorage section of the sealing profile engaging in the groove. Such a through-hole can be implemented in a simple manner and without additional costs during the manufacturing of the groove required in any event.

In particular the through-hole can be conveniently created by a channel aligned transverse to the longitudinal direction of the groove in side walls of the groove in each case.

To make the length of the through-hole large a section of the through-hole is preferably routed in the longitudinal direction of the groove. This section can be created without any effort if it is delimited on one side by a wall of the groove and on the other side by the sealing profile.

If a rib is formed on the floor of the groove which engages in a longitudinal channel of the seal, this rib is preferably interrupted locally, in order to form the through-hole.

Preferably at least one end of the through-hole is further arranged at a corner of the door, since the corners are generally the warmest areas of the door.

BRIEF DESCRIPTION OF THE DRAWINGS

Further features and advantages of the invention emerge from the description of exemplary embodiments given below, which refers to the enclosed figures. The figures are as follows.

DETAILED DESCRIPTION OF THE PRESENT INVENTION

Figure 1:
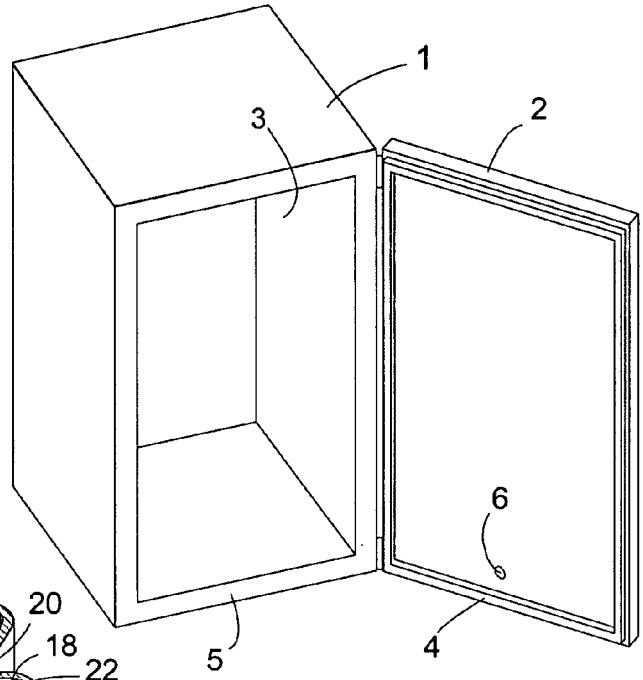
FIG. 1 a schematic perspective view of a refrigerator on which the present invention is able to be used.

FIG. 1 is a schematic perspective view of a refrigeration device with a chassis 1 and a door 2 hinged onto it, which enclose a chilled interior 3. Attached to the inner side of the door 2 facing towards the chassis 1 in a known manner is a magnetic seal 4, which in the closed position of the door 2 fits tightly against a front side 5 of the chassis 1. The front side 5 is heated up by a refrigerant line not visible in the diagram running within the interior of the chassis 1 adjacent to the front side 5 around the interior 3, which is connected between the pressure outlet of a compressor and a condenser and has warm refrigerant flowing through it while the compressor is operating.

Figure 2:
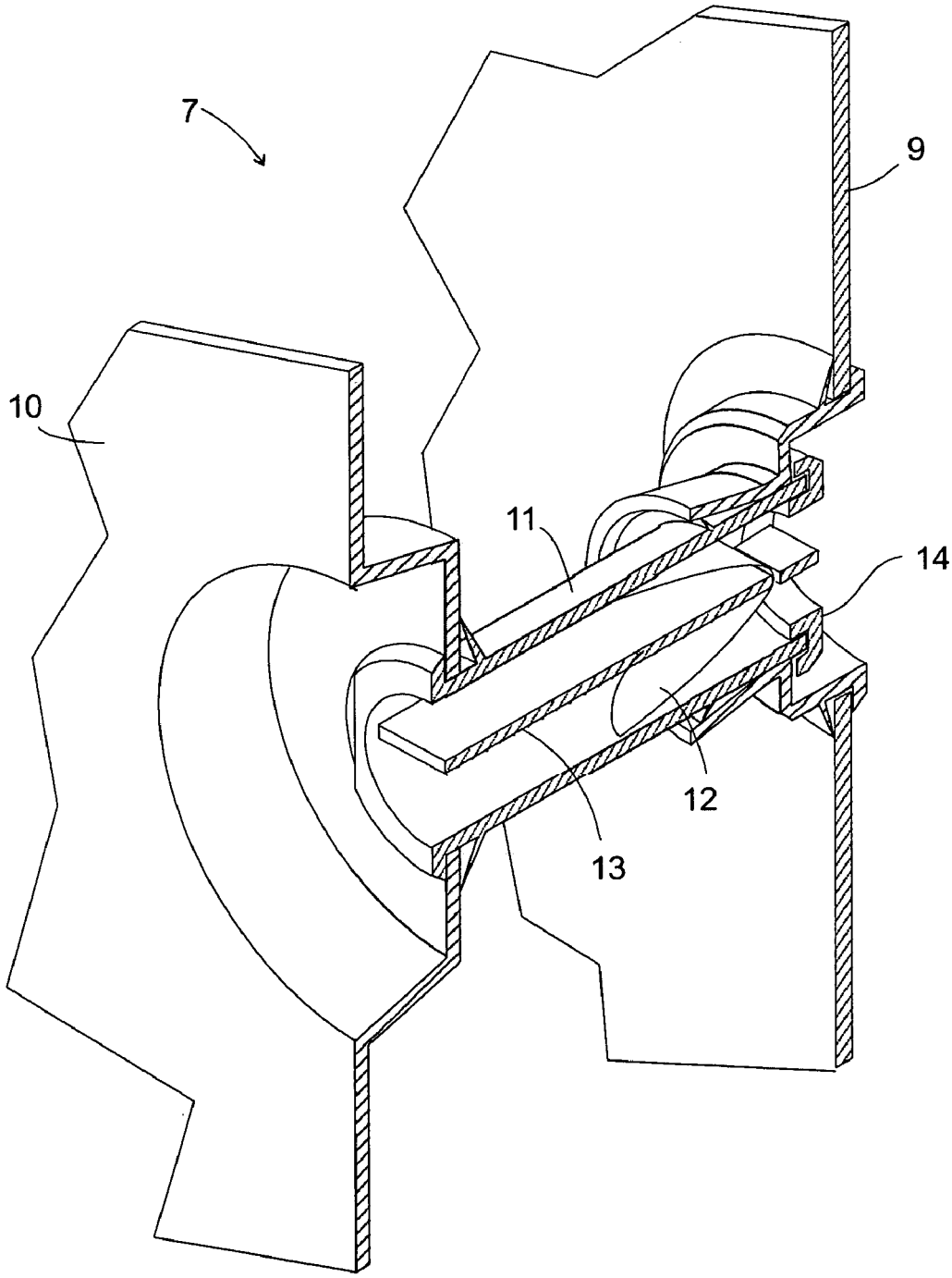
FIG. 2 a section through a pressure equalization valve.

Accommodated in an opening 6 made in the lower area of the door 2 is a pressure equalization valve. An example for a possible structure of the pressure equalization valve is shown in FIG. 2 which shows a perspective longitudinal section through the pressure equalization valve 7. Between an outer panel 9 of the door 2 and a deep-drawn inner wall 10 made of plastic extends a sleeve 11 attached foam-tight to the inner wall 10 by a bayonet fitting 11. A membrane 12 held inside the sleeve 11 under bending stress has edges lying tightly against the walls of the sleeve 11 and is held in position by a partition wall 13 extending across the inside of the sleeve 11 and a collar 14. In the case of a vacuum in the interior 3 air flows through between the edges of the membrane 12 and the sleeve 11 in order to equalize the vacuum; an excess of pressure in the interior 3 on the other hand presses the membrane 12 against the sleeve 11 and thus increases the sealing effect of the valve 7.

Figure 3:
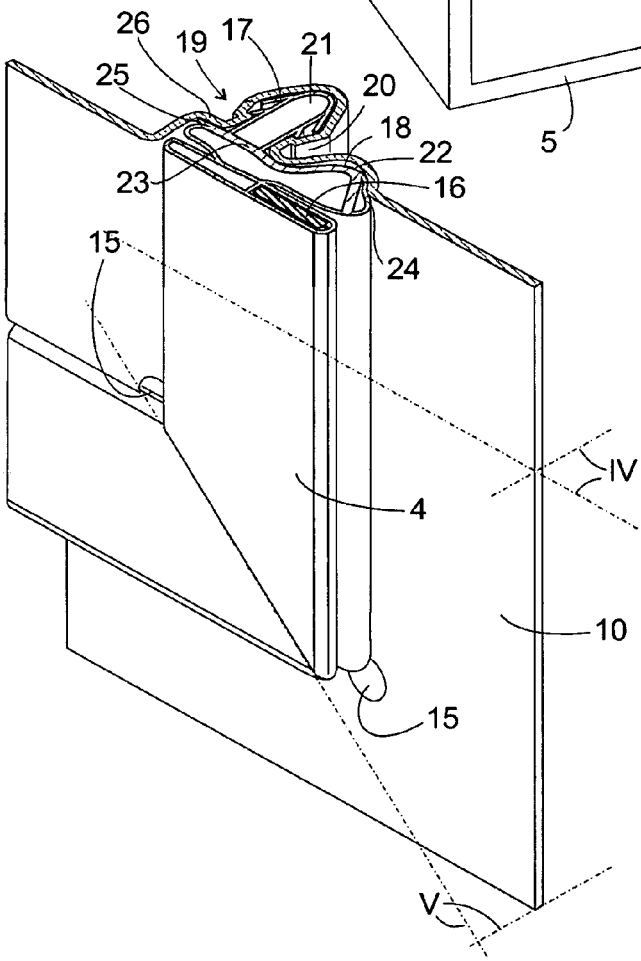
FIG. 3 a lower corner of the inner wall of a refrigerator door in accordance with the present invention.

In order, when the interior 3 is cooling down in an operating phase of the compressor, to prevent air flowing slowly from outside through the valve 7 and moisture contained therein condensing out onto the valve 7, a through-hole 15 is provided on the door 2 running parallel to the valve 7, through which air can pass in both directions, of which two ends can be seen in FIG. 3.

FIG. 3 is a perspective view of a lower corner of the inner wall 10 as well as the magnetic seal 4 attached to the inner wall 10. The magnetic seal 4 is a flexible extrusion profile with multiplicity of longitudinal chambers, of which one contains a magnetic band 16 which is provided to press the magnetic seal 4 against the ferromagnetic front side 5 of the chassis 1.

Formed on a rear side of the magnetic seal 4 facing away from the chamber containing the band 16 are two projections 17, 18, of which one 17, is equipped with barbs. The projections 17, 18 engage in a groove 19 of the inner wall 10, which is subdivided by a rib 20 running in a longitudinal direction of the groove 19 into an inner and an outer section 21, 22. The barbs of the projection 17 are latched into undercuts of the inner section 21. A convex transverse wall 23 extending in the lateral direction of the magnetic seal 4, into the section 22 is held by the latching in a bend stressed setting, in which it holds the projection 18 pressed into the outer section 22 of the groove 19. A thin, flexible wall section 24 of the magnetic seal 4 is bent inwards by an edge of the outer section 22, so that the wall section 24 essentially closely abuts this edge. Formed on an opposite edge of the transverse wall 23 is a lip 25 which is pressed by the latching of the projection 17 tightly against a shoulder 26 of the inner wall 10 abutting the inner section 21. The wall section 24, the lip 25 as well as the barbs of the projection 17 form a number of sealing lines between the inner wall 10 and the magnetic seal 4.

Figure 4:
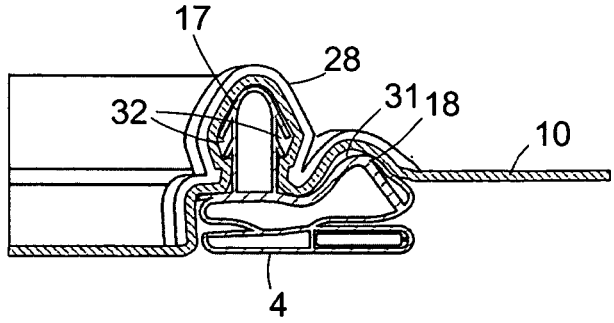
FIG. 4 a section through the inner wall and a sealing profile anchored thereon along the plane labeled IV in FIG. 2.

These sealing lines however do not extend over the entire length of the magnetic seal 4, but are interrupted by a through-hole 15 at the corner of the door 2 shown. The through-hole 15 is formed by a recess being made in the inner wall at the location where a horizontal and a vertical section of the groove 19 meet. In FIG. 4, which shows a section through the inner wall 10 and the magnetic seal 4 along the plane labeled with IV in FIG. 3, an outer outline 28 of this recess is visible.

Figure 5:
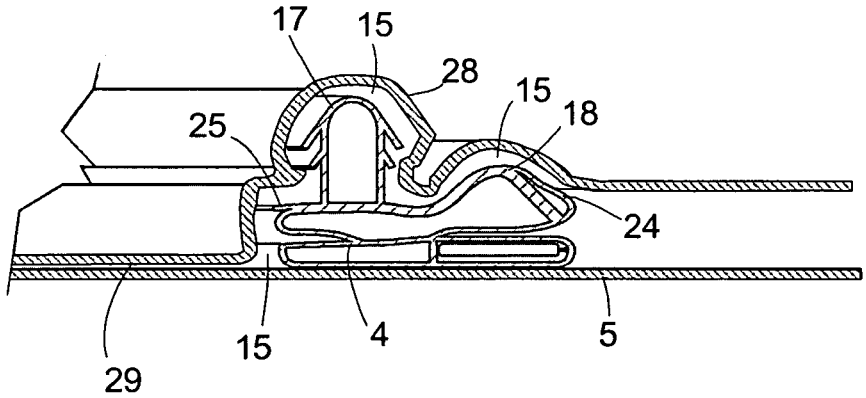
FIG. 5 a section along the plane labeled V of FIG. 2.

FIG. 5 shows a section along the plane labeled V in FIG. 3 inclined at 45° to the horizontal. The sectional plane runs along the through-hole 15, and it is evident that along this sectional plane neither the wall section 24 nor the barbs nor the lip 25 touch the inner wall 10. An exchange of air between inside and outside bypassing the pressure equalization valve 7 is thus possible, with the course of the through-hole 15 changing its direction alternately as a type of labyrinth seal prevents a free exchange of air between the interior 3 and the surroundings. Since the through-hole 15 is heated by the front side 5 on the one hand and on the other hand air which has passed through the through-hole 15, before reaching the interior 3, must still pass a temperature equalizing gap 29 between the inner wall 10 and the front side 5, no danger exists of the through-hole becoming blocked by an excess of condensation.

Figure 7:
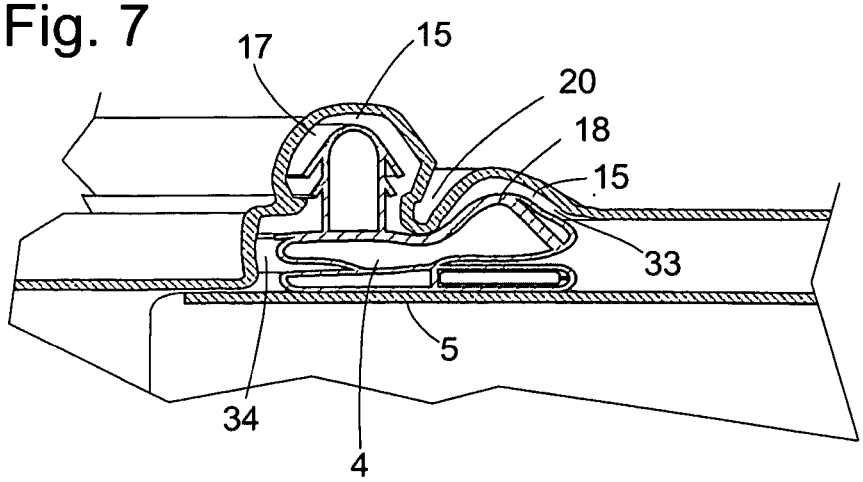
FIG. 7 a section along the plane labeled VII in FIG. 6.
Figure 6:
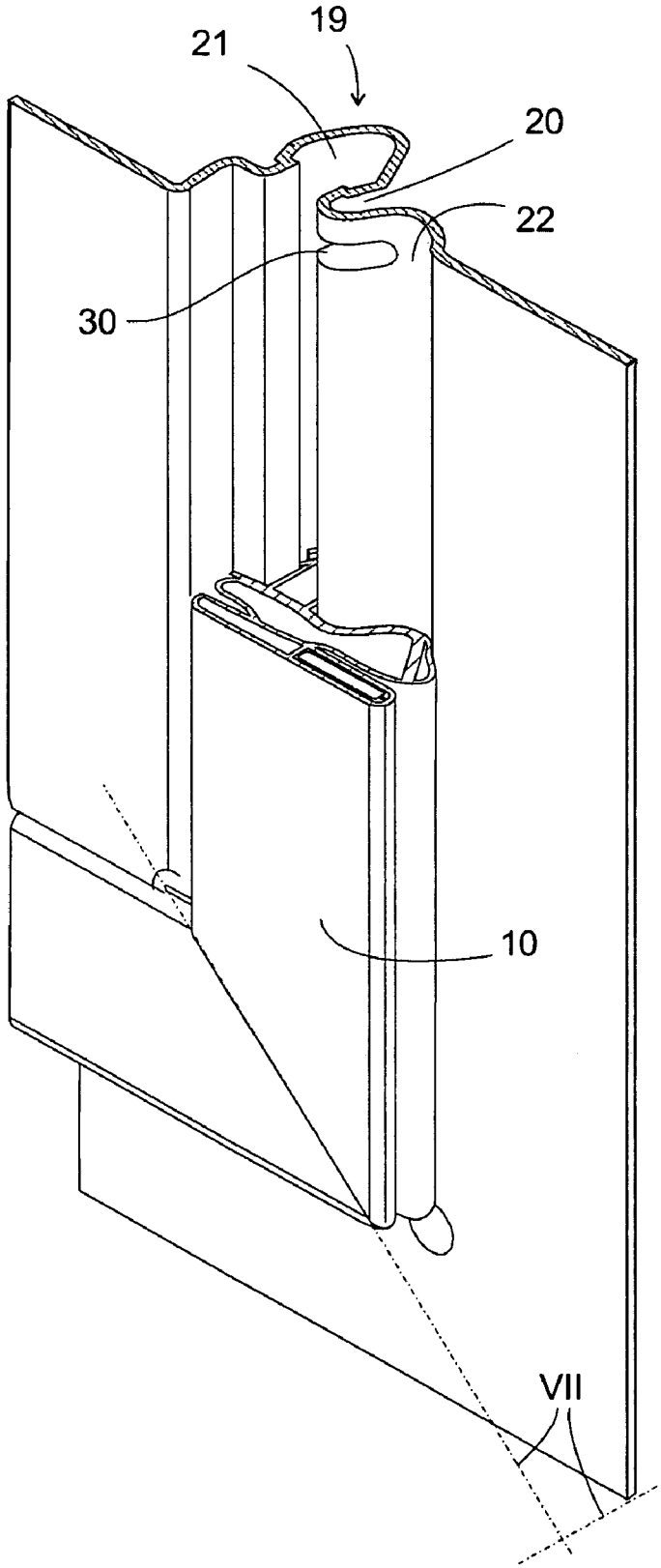
FIG. 6 a perspective view of a corner of the inner wall of a refrigerator door and of a sealing profile fitted therein in accordance with a second embodiment of the invention.

A developed embodiment of the invention is described with reference to FIGS. 6 and 7. Like FIG. 2, FIG. 6 is a perspective view of a corner of the inner wall 10, with the groove 19 of the inner wall 10 only being shown equipped over a part of its length with the magnetic seal 4, in order to enable a section 30 formed in the rib 20 separating the sections 21, 22 of the groove 19 from each other to be shown. The cross-sections of the groove 19 and the magnetic seal are the same as those in the embodiment of FIG. 1 through FIG. 5. As is evident with reference to the section of FIG. 7 similar to that shown in FIG. 5, in the sectional plane of this figure the through-hole 15 is interrupted by the rib 20. As can be seen however with reference to FIG. 4, in both sections 21, 22 of the groove 19, longitudinal channels 31, 32 delimited on one side by the walls of the groove 19 and on the other side by the magnetic seal 4 itself, from which at the height of the corner shown in FIG. 6, the one 31 communicates via an outer section 33 of the through-hole 15 (see FIG. 7) with the surroundings and the other 32 via an inner section 34 of the through-hole 15 with the interior 3. The two longitudinal channels 31, 32 are connected to each other via the cutout 30. The fact that the cutout 30 is arranged at a great distance from the corner in which the two sections 33, 34 are arranged enables the length of the entire through-hole to easily be made larger than the length of the edge of the door 2. The large length of the through-hole, despite a possibly large cross section of the individual sections of the through-hole, leads to a lower value through which an exchange of air between interior 3 and surroundings, which goes beyond the level caused by temperature fluctuations of the interior 3, to be reliably suppressed.

The invention claimed is:

1. A refrigerator comprising a housing with a chassis and a door enclosing a chilled interior; and a pressure equalization valve extending through a wall of the housing thereby facilitating an inflow of air from the surroundings into the interior and thereby blocking an outflow of air from the interior into the surroundings, the refrigerator comprising, a wall having a throughbore formed therein in a parallel flow arrangement with the pressure equalization valve, through which air can pass in two directions, wherein the flow of air is less than that of the airflow through the pressure equalization valve in a throughflow direction and greater than that of the air leakage value of the pressure equalization valve in the blocked direction.

2. The refrigerator according to claim 1 wherein the throughbore extends through the wall on a curved path.

3. The refrigerator according to claim 1 and further comprising a heater in thermal contact with the throughbore.

4. The refrigerator according to claim 3 wherein the heater is disposed on a front side of the chassis and that the throughbore is present in an area of the housing heated by the heater.

5. The refrigerator according to claim 1 and further comprising a sealing member for sealing a gap between door and chassis, wherein the sealing member is anchored in a groove of the door and the throughbore extends between the walls of the groove and an anchorage section of the sealing profile engaged with the groove.

6. The refrigerator according to claim 5 wherein the throughbore includes at least one section extending in the longitudinal direction of the groove.

7. The refrigerator according to claim 5 wherein a channel is formed in sidewalls of the groove and is aligned transverse to the longitudinal direction of the groove.

8. The refrigerator according to claim 5 wherein the groove is divided laterally by a rib in engagement with a longitudinal channel of the sealing member, and that the rib is interrupted locally to form at least a portion of the throughbore.

9. The refrigerator according to claim 5 wherein at least one end of the throughbore is disposed at a corner of the door.

* * * * *